US006699069B2

(12) United States Patent
Inoue

(10) Patent No.: US 6,699,069 B2
(45) Date of Patent: Mar. 2, 2004

(54) ON-BOARD TYPE CONNECTOR

(75) Inventor: Takuya Inoue, Nagoya (JP)

(73) Assignees: Autonetworks Technologies, Ltd., Nagoya (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 223 days.

(21) Appl. No.: 09/972,861

(22) Filed: Oct. 10, 2001

(65) Prior Publication Data

US 2002/0045367 A1 Apr. 18, 2002

(30) Foreign Application Priority Data

Oct. 13, 2000 (JP) ..... 2000-313434

(51) Int. Cl.[7] ..... H01R 13/73
(52) U.S. Cl. ..... 439/570; 439/566
(58) Field of Search ..... 439/567, 570–573, 439/83, 566

(56) References Cited

U.S. PATENT DOCUMENTS 5,259,789 A * 11/1993 Patel et al. ..... 439/570
5,395,265 A * 3/1995 DiMondi et al. ..... 439/566
5,626,482 A * 5/1997 Chan et al. ..... 439/570
5,704,807 A * 1/1998 Sherman et al. ..... 439/570
6,042,420 A * 3/2000 Long ..... 439/570
6,152,765 A * 11/2000 Tang et al. ..... 439/567
6,227,906 B1 * 5/2001 Fan ..... 439/570
6,231,386 B1 * 5/2001 Wu ..... 439/570

* cited by examiner

*Primary Examiner*—Hien Vu
(74) *Attorney, Agent, or Firm*—Oliff & Berridge, PLC

(57) ABSTRACT

An on-board type connector which includes a housing 20 made of synthetic resin for holding terminals 10, and reinforcing metal plates 50 integrally having parts 54 to be fixed on board and parts 55 to be fixed to the housing which are adapted to be fixed to both sides of the housing 20 in a lateral direction. The housing 20 is provided, at both sides thereof in the lateral direction, with insertion slits 24*a* which open toward a bottom face of the housing. These parts 55 to be fixed to the housing are restrained from the back and the forth by a restraining part 25 of the housing 20, in a state where the parts 55 have been inserted into the insertion slits 24*a* from the bottom face side of the housing.

4 Claims, 9 Drawing Sheets

ON-BOARD TYPE CONNECTOR

BACKGROUND OF THE INVENTION

1. Field of the Invention

The present invention relates to an on-board type connector which is adapted to be mounted on a circuit board.

2. Description of the Related Art

Generally, the on-board type connector is constructed in such a manner that its terminals are respectively provided with leg portions, and the leg portions are connected to and fixed on the circuit board by soldering or so. However, with such fixation of the connector only by means of soldering between the leg portions of the terminals and the circuit board, high connection reliability cannot be obtained, because an outer force exerted on the relevant connector will be transferred as it is, to the soldered parts (terminal connecting parts) and will cause a large overload in strength on the soldered parts. In view of the circumstances, it has been considered heretofore to decrease the overload in strength by fixing a reinforcing metal to a housing of the connector, and fixing this metal on the circuit board by soldering or so independently of the terminals.

One example of such a structure is shown in FIGS. 9 to 11. A connector illustrated on the drawings is intended to electrically connect a flat wiring member 40 which is flat and flexible, to a circuit board C as shown in FIG. 10. The connector includes a number of terminals 10, a housing 20 for holding the terminals, and a slider 30 attached to this housing 20.

Each of the terminals 10 is formed of conductive material such as metal, and integrally has a leg portion 12 in a substantially L-shape which is mounted on the circuit board C as shown in FIG. 10, an upper horizontal portion 14 horizontally extending from an upper end of the leg portion 12, a lower horizontal portion 16 branched off downward from a base end of the upper horizontal portion 14 and extending in parallel to the upper horizontal portion 14, and a conductor contacting portion 18 which is turned back from an end of the lower horizontal portion 16 at an acute angle. These terminals 10 are held by the housing 20 in such a manner that they are directed in a back and forth direction and arranged in a row in a lateral direction.

The housing 20 is integrally molded of synthetic resin in its entirety, and has a body part 21 which extends laterally, and a top wall part 22 which extends in parallel to the body part 21 above a backward half part of the body part 21. These body part 21 and top wall part 22 are connected vertically at a back part, and left and right sides of the housing. The body part 21 is formed with terminal containing grooves 21*a* extending in a back and forth direction which are adapted to contain the lower horizontal portions 16 of the aforesaid terminals 10, so that the conductor contacting portions 18 of the terminals 10 may project upward from the terminal containing grooves 21*a*. There are formed, on a lower face of the top wall part 22, terminal insertion grooves 22*a* into which the upper horizontal portions 14 of the terminals 10 are respectively inserted.

The slider 30 is also integrally formed of insulating material, and has a shape of extending in a lateral direction of the flat wiring member 40. More specifically, the slider 30 integrally has a pair of left and right side walls 32 extending in a back and forth direction, and a laterally extending connecting part 34 which connects both the side walls 32. A wiring member holding piece 35 extends backward from the connecting part 34. There are further formed, on inner faces of both the side walls 32, lockable portions 36 which project inwardly.

On the other hand, at an end of the flat wiring member 40 to be inserted into the housing 20, an insulating layer on its lower face is peeled off to expose an inner conductor at its lower side, and a reinforcing plate 42 is fixed to an upper face of the end by means of boding or the like.

In a state where the slider 30 has been completely withdrawn forward from the housing 20, the end of the flat wiring member 40 is inserted into a space between the upper horizontal portion 14 and the conductor contacting portion 18 of the terminal 10 in the housing 20, from underneath of the connecting part 34 and the wiring member holding piece 35 of the slider 30. Thereafter, the slider 30 is pushed into the housing 20 toward its backward end, and comes into a state where the wiring member holding piece 35 of the slider 30 has pressed the end of the flat wiring member 40 onto an upper side of the conductor contacting portion 18, as shown in FIG. 10. In this manner, the exposed portion of the conductor at the end of the flat wiring member is press contacted with the conductor contacting portion 18, and both the members are electrically connected. When the slider 30 has been completely inserted, the lockable portions 36 come into engagement with the locking projections 28 provided on the side walls of the housing 20, thereby to retain the slider 30 from dropping.

It is intended with this connector that a pair of left and right metal plates 50 for reinforcement as shown in FIGS. 11A and 11B are fixed to this connector. Each of the reinforcing metal plates 50 is formed of a single metal plate by bending work, and integrally has a part 51 to be fixed on the circuit board C, and apart 52 to be fixed to the housing which is erected upward from a side of a backward end of the part 51 to be fixed on the board. There is formed a cut-out 52*a* at a middle position of a front edge of the part 52 to be fixed to the housing.

On the other hand, at both ends in a lateral direction of the housing 20, there are formed backwardly opening slits 23 along an entire length of the housing 20 in a vertical direction. At a middle position of each of the slits 23, there is formed a backwardly projecting projection 23*a*.

By press fitting the parts 52 of the reinforcing metal plate 50 to be fixed to the housing into the slits 23 from the back side (in other words, by press fitting the projections 23*a* into the cut-outs 52*a*), the reinforcing metal plate 50 is fixed to the housing 20. Then, by fixing the parts 51 to be fixed on the board in this reinforcing metal plate 50 to the circuit board C which is not shown in the drawing, by soldering or so, the overload in strength exerted on the connecting positions between the leg portions of the terminals 10 and the circuit board C can be reduced.

Recently, the above described connector, particularly the connector for an automobile has come to have multi-contacts, and accordingly, requires a larger force than ever for inserting and detaching the slider 30 as described above or a connector to be mated. In the conventional connector as described above, the parts 52 of the reinforcing metal plate 50 to be fixed to the housing are inserted into the slits 23 of the housing 20 from the back side. Accordingly, it is difficult to withstand a force of pulling the housing 20 forward, that is, a force exerted on the housing 20 (a leftward force in FIGS. 11A and 11B) when the slider 30 is extracted from the relevant connector (when the relevant connector is detached in case where the connector is to be mated), and there is a fear that the force may exert a large overload on the connecting positions between the leg portions of the terminals 10 and the circuit board C.

SUMMARY OF THE INVENTION

In view of the above described circumstances, it is an object of the invention to provide an on-board type connector which is simple in structure, and in which an overload in strength exerted on connecting positions between terminals and a circuit board can be effectively reduced, even when a slider or a connector to be mated is connected to or detached from a housing.

To solve the above described problems, there is provided according to the invention, an on-board type connector comprising a housing made of synthetic resin which holds a plurality of terminals to be connected to a circuit board in such a manner that the terminals are directed in a back and forth direction and laterally arranged, and two reinforcing metal plates fixed to both sides of the housing in a lateral direction, the reinforcing metal plates integrally having parts to be fixed to both sides of the housing made of synthetic resin in the lateral direction and parts to be fixed on the circuit board, characterized in that the housing is provided, at both sides thereof in the lateral direction, with insertion slits which open toward a bottom face of the housing, and into which the parts to be fixed to the housing are inserted from the bottom face and fixed, the insertion slits being so shaped that the parts to be fixed to the housing which have been inserted into the slits are restrained by the housing from both a front and a back sides.

According to this structure, the overload in strength exerted on the connecting positions between the relevant circuit board and the terminals can be reduced, by fixing the parts of the reinforcing metal plates to be fixed on the circuit board on the relevant circuit board in a state where the reinforcing metal plates are inserted into the insertion slits which are formed in the housing and fixed. Moreover, the insertion slits open toward the bottom face of the housing, and the parts to be fixed to the housing are inserted from the bottom face and fixed, to be restrained by the housing from both the front and the back sides. Therefore, an outer force applied to the terminals and the housing when the slider or the connector to be mated is inserted or detached can be sufficiently withstood, and the overload in strength exerted on the connecting positions between the terminals and the circuit board can be effectively reduced.

More specifically, it is preferable that the parts of the reinforcing metal plate to be fixed to the housing may be formed at both sides of the relevant reinforcing metal plate in a back and forth direction, while the insertion slits may be formed at both forward and backward sides of the housing, and a restraining part adapted to restrain the parts to be fixed to the housing from inside may be formed at an intermediate position between the insertion slits.

According to this structure, because the parts to be fixed to the housing are inserted at both sides of the housing in the back and forth direction, effective reinforcement can be attained along an entire area in the back and forth direction. Furthermore, the part of the housing (the restraining part) interposed between both the parts to be fixed to the housing can effectively restrain the parts to be fixed to the housing from both the back and the forth.

In addition, by constructing the two reinforcing metal plates so that they may have a shape identical to each other, mass production can be promoted, and the cost can be reduced.

Especially, provided that the two reinforcing metal plates have a symmetrical shape as seen in the lateral direction of the housing, common use of the two reinforcing metal plates can be realized while maintaining a balanced structure.

Although there are no specific means according to the invention for fixing the parts to be fixed to the housing to the relevant housing, the parts to be fixed to the housing may be provided on their surfaces with hooks which are adapted to be engaged with inner walls of the slits. By engaging the hooks in this manner, reliable fixation can be attained with a simple structure.

DETAILED DESCRIPTION OF THE PRESENT INVENTION

The present invention will be described with reference to the accompanying drawings.

Figure 9:
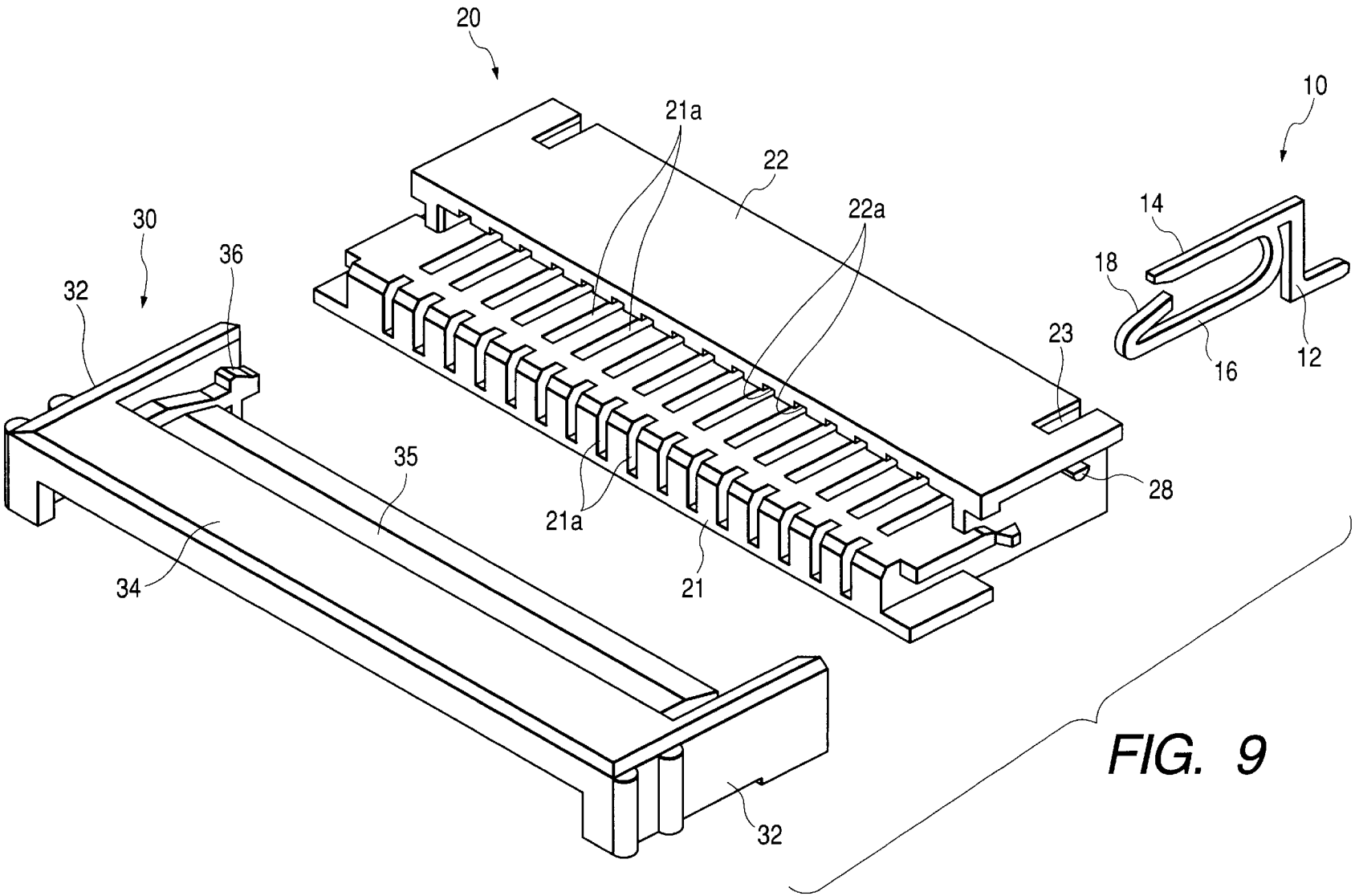
FIG. 9 is an exploded perspective view of one example of conventional on-board type connectors.
Figure 10:
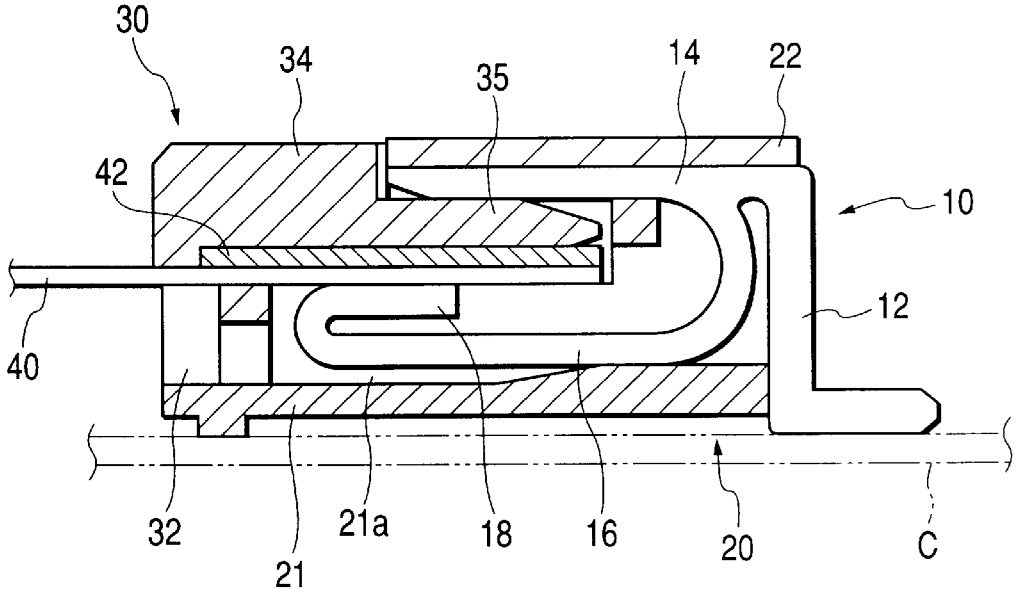
FIG. 10 is a sectional side view of the connector as shown in FIG. 9.
Figure 11A:
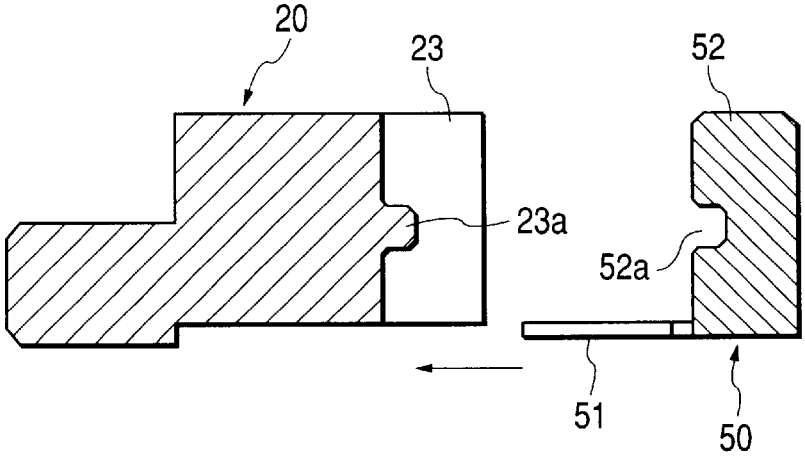
FIG. 11A is a sectional view taken along a line A—A of FIG. 11B.
Figure 11B:
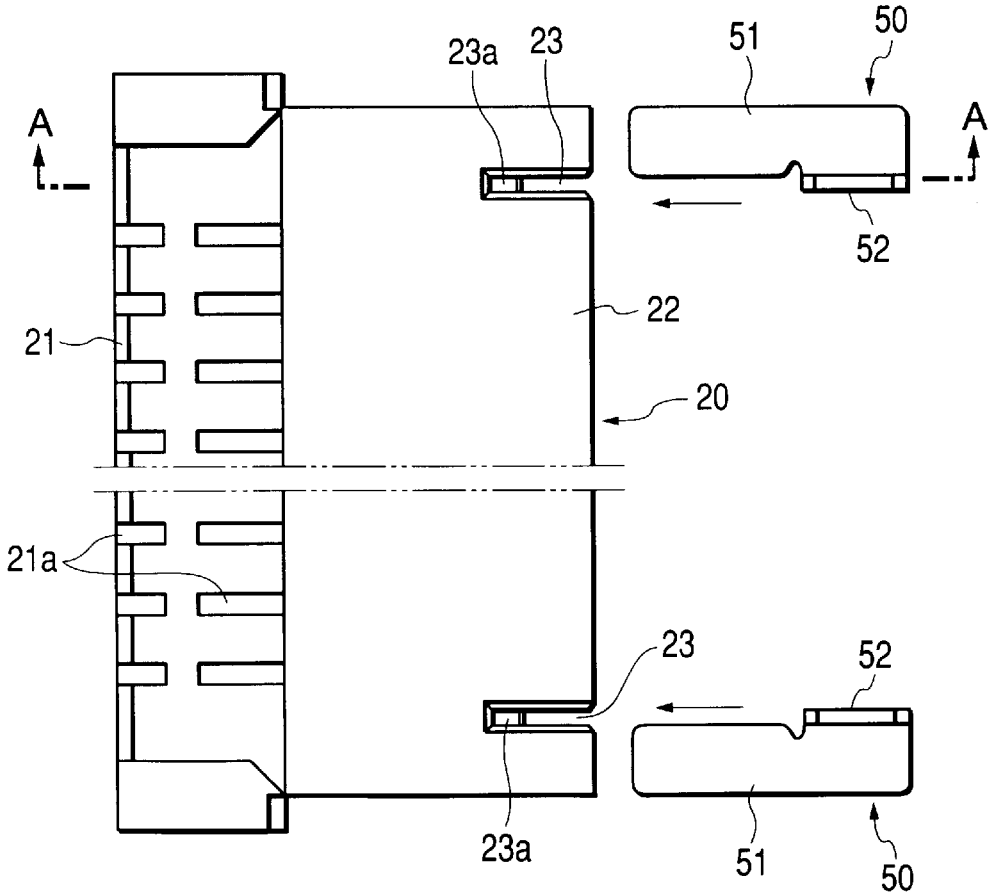
FIG. 11B is a plan view of a housing of the connector as shown in FIG. 9 and a reinforcing metal plate fixed to the housing.

A first embodiment of the invention will be described referring to FIGS. 1 to 5. This embodiment is substantially equal to the above described example as shown in FIGS. 9 to 11, except the shape of the reinforcing metal plate 50 and the structure wherein the reinforcing metal plate 50 is fixed to the housing 20, and so, the relevant explanation will be omitted here.

Figure 1:
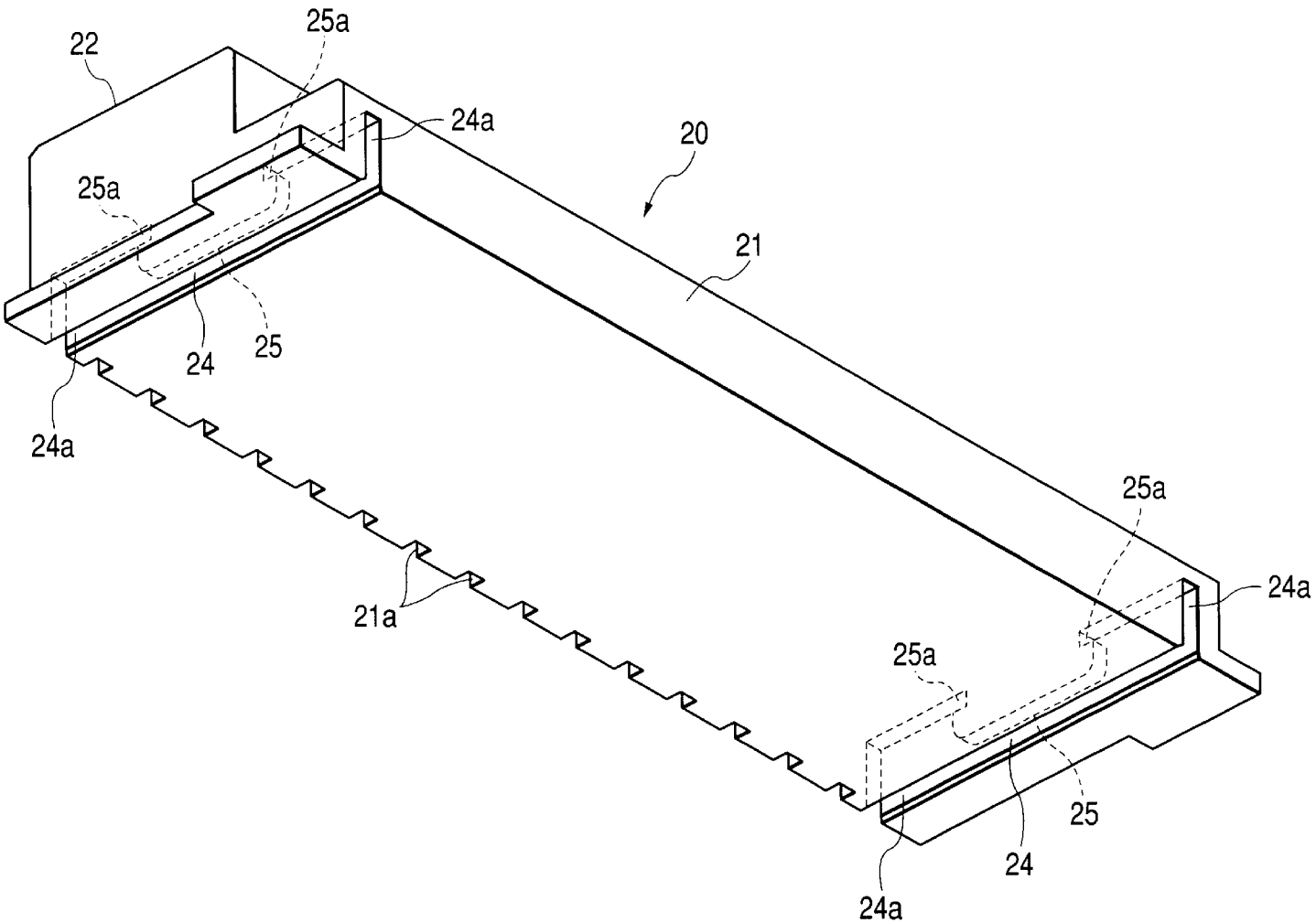
FIG. 1 is an exploded perspective view of a housing of a connector in a first embodiment of the invention, as seen from a bottom face side of the housing.
Figure 2:
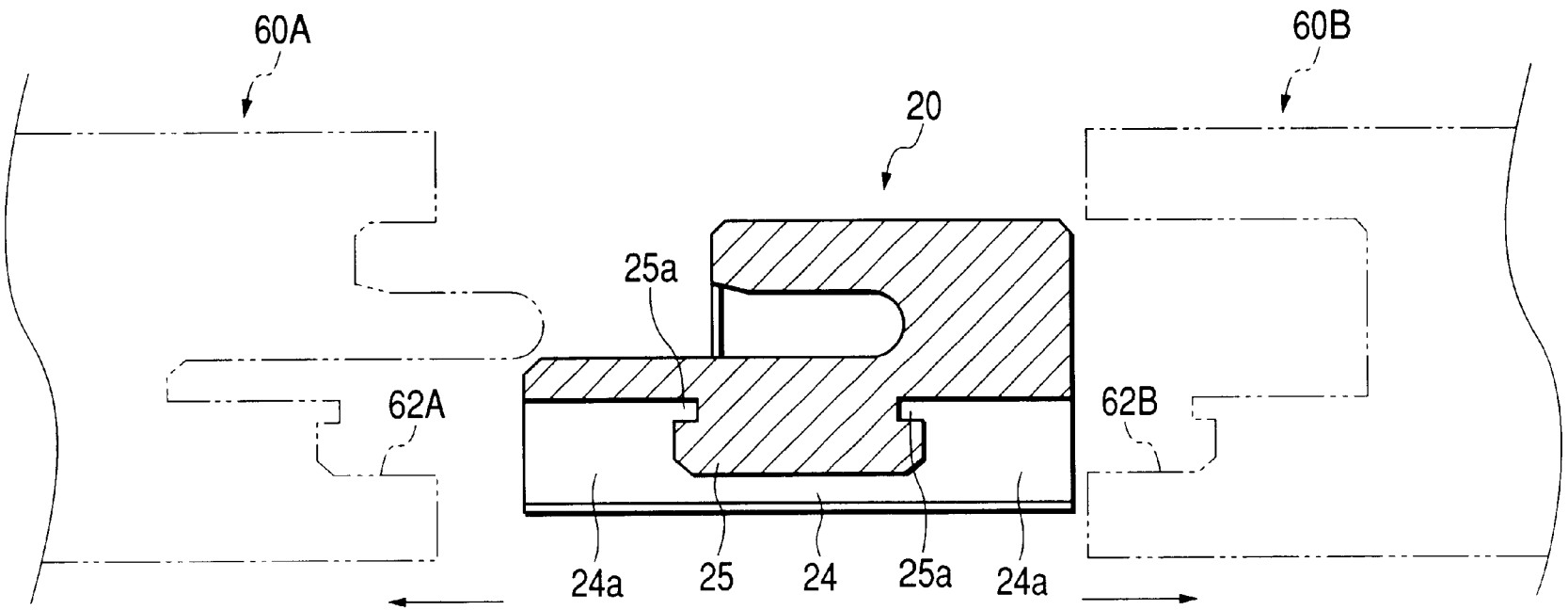
FIG. 2 is a sectional side view showing the housing and molds for forming the housing.

In this embodiment, as shown in FIGS. 1 and 2, there are formed insertion slits 24 at both sides of the housing 20. The slits 2 are open at their longitudinal ends. At an intermediate position in each of these insertion slits 24, there are restraining members 25. The restraining member 25 of each slit 2 divides the slit into two slit portions 24*a*. At an upper end position (a root position) of each restraining member 25, there are formed dented portions 25*a* which are dented toward a center of the restraining member 25. The slits 24 can be formed in the housing 20 by employing molds 60A and 60B including parts 62A, 62B each having a shape of half of the slit 24, as shown by phantom lines in FIG. 2, and by extracting the molds 60A and 66B in opposite directions.

On the other hand, the reinforcing metal plate 50 is formed of a single metal plate by bending work, and integrally has a circuit board fixing portion 54 to be fixed on the board and which extends along the entire length of the housing, and a pair of housing fixing portions 55 to be fixed to the housing an which extend upward from the circuit board fixing portion 54. Each of the housing fixing portions 55 is capable of being inserted into a respective one of the slit portions 24*a*. There is formed an inwardly projecting hook 55*a* at an upper end of an inner end face of each h using fixing portion 55.

Figure 3:
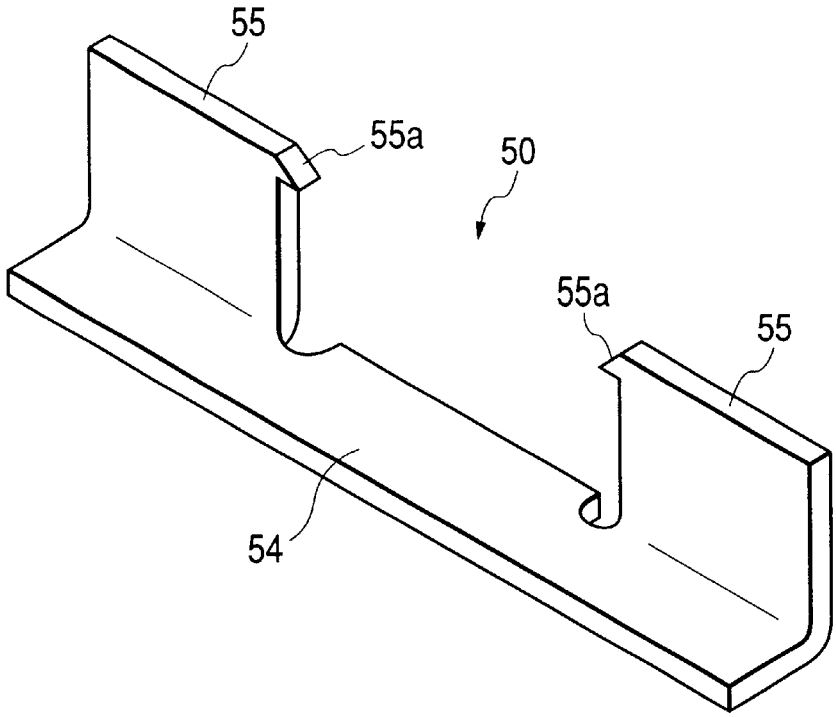
FIG. 3 is a perspective view of a reinforcing metal plate provided in the connector.
Figure 4:
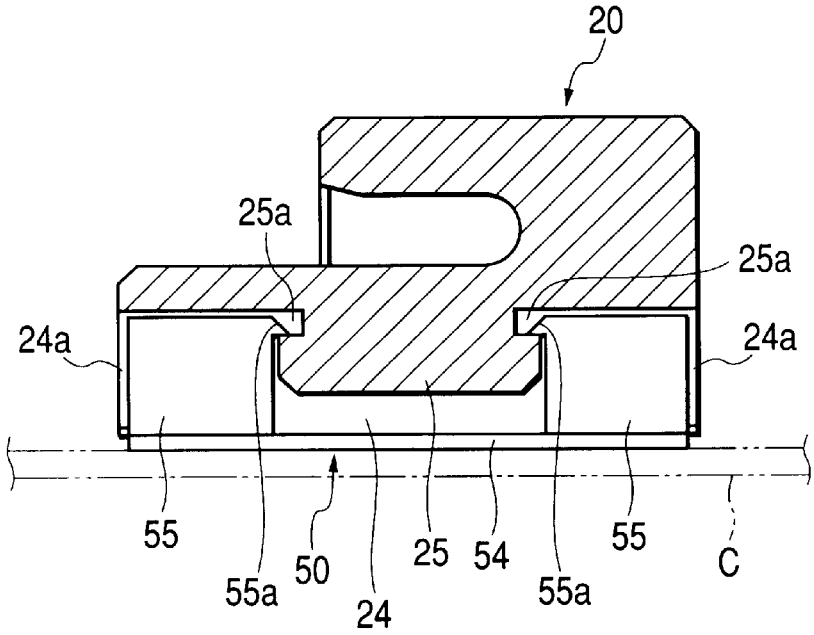
FIG. 4 is a sectional side view showing the reinforcing metal plate in a fixed state to the housing.
Figure 5:
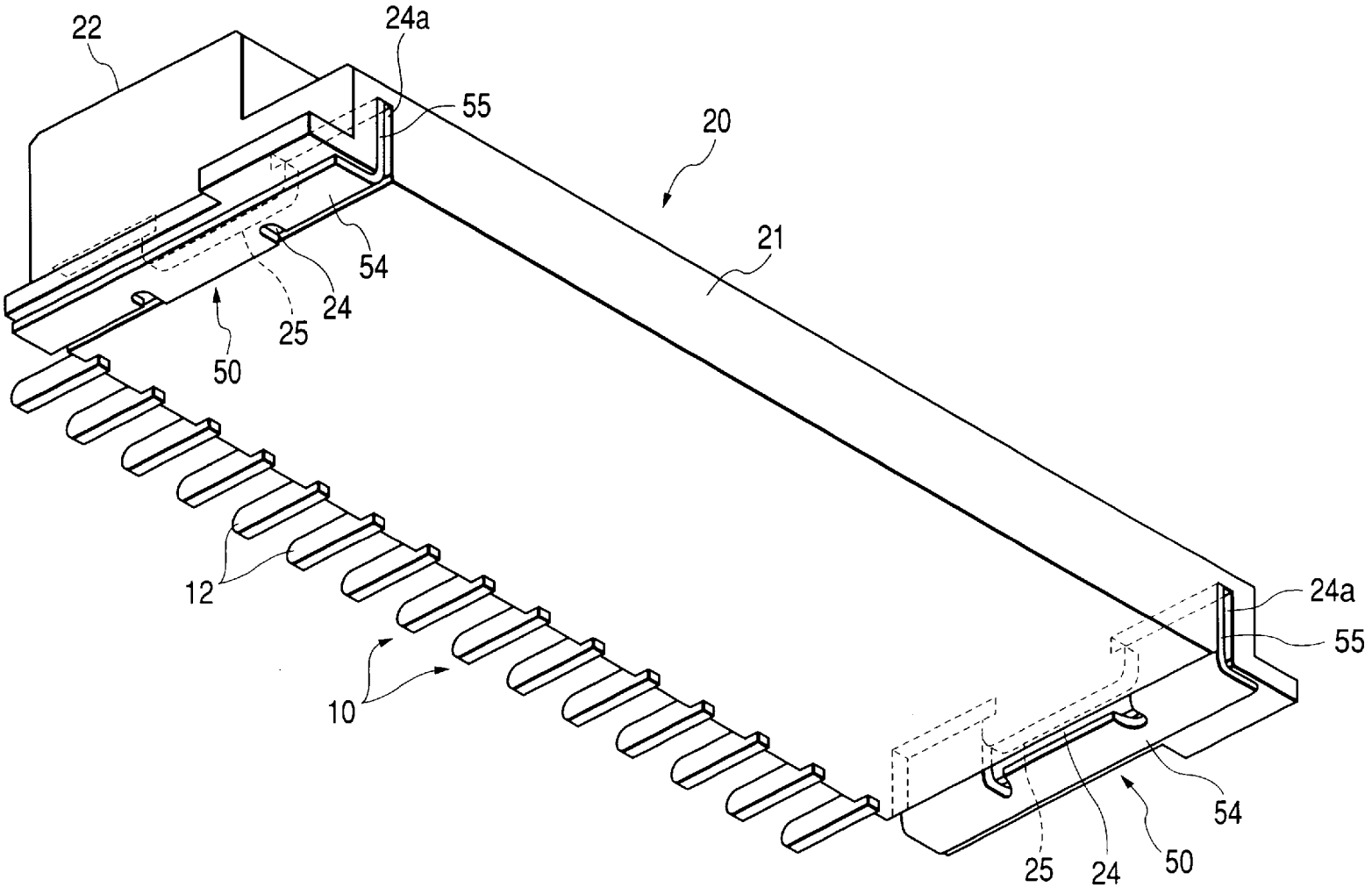
FIG. 5 is a perspective view of the reinforcing metal plate in a fixed state to the housing as seen from the bottom face side of the housing.

In such a structure, by fitting the terminals 10 in the respective terminal containing grooves 21*a* of the housing 20, and at the same time, by inserting the housing fixing portions 55 of the reinforcing metal plates 50 into the respective slit portions 24*a*, and by engaging the hooks 55*a* of the housing fixing portion 55 with the dented portions 25*a* of the restraining members 25, the reinforcing metal plates 50 can be fixed to the housing 20 (refer to FIGS. 3 to 5). Thereafter, the leg portions 12 of the terminals 10 are connected to appropriate positions on the circuit board C by soldering or the like, and the circuit board fixing portions 54 of the reinforcing metal plates 50 are fixed to appropriate positions on the circuit board C by soldering or the like. In this manner, the overload in strength exerted on the connecting positions of the aforesaid leg portions 12 can be reduced.

Moreover, with this structure, different from the conventional structure as shown in FIGS. 9 to 11, each housing fixing portion 55 is inserted into a respective one of the slit portions 24*a* of the housing 20 from a bottom face side of the housing, and is restrained by the restraining member 25 which is interposed between the housing fixing portions 55. Consequently, an external force applied to the housing 20 when the slide 30 is inserted and detached can be sufficiently withstood, a d the connecting positions of the leg portions 12 can be effectively protected.

It is to be noted that the insertion slits 24 are not necessarily formed along the entire length of the housing 20, but may be completely divided by the restraining members 25. In this case too, the slit portions 24*a* had better be so shaped that they respectively open toward the front and rear of the housing 20 in the same manner as in the illustrated structure, so that the molds 60A, 60B can be extracted in opposite directions (that is, directions parallel to an insertion direction of the terminals) as s own in FIG. 2. As a result, the structure has an advantage that installation of the molds will be simplified.

In addition, each of the reinforcing metal plates 50 may be shaped symmetrically as seen in a lateral direction of the housing, and two reinforcing metal plates 50 having the same shape can be employed, as shown in the drawings. Thus, mass production can be promoted, and the manufacturing cost can be further reduced.

Figure 6:
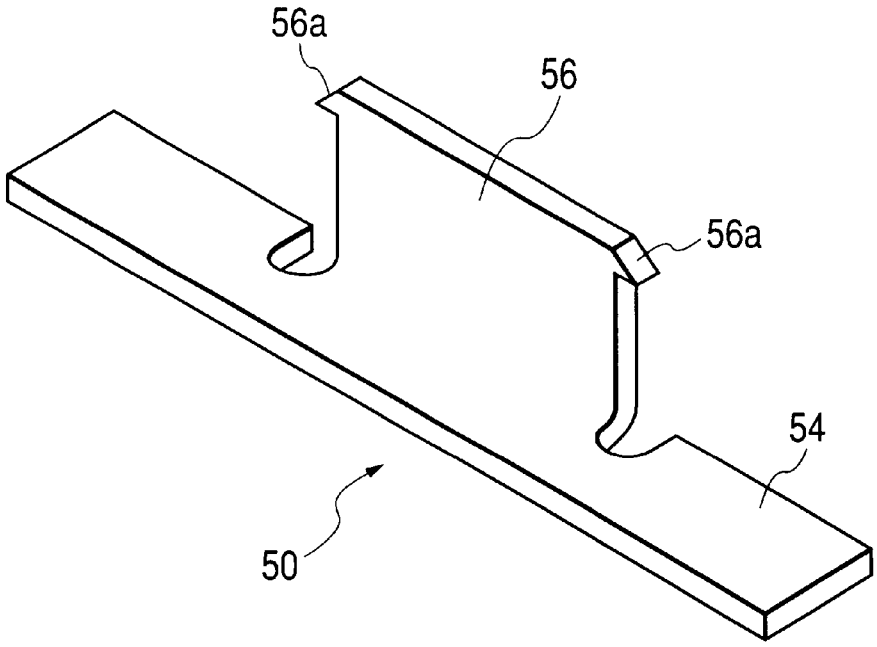
FIG. 6 is a perspective view of the reinforcing metal plate in a second embodiment of the invention.
Figure 7:
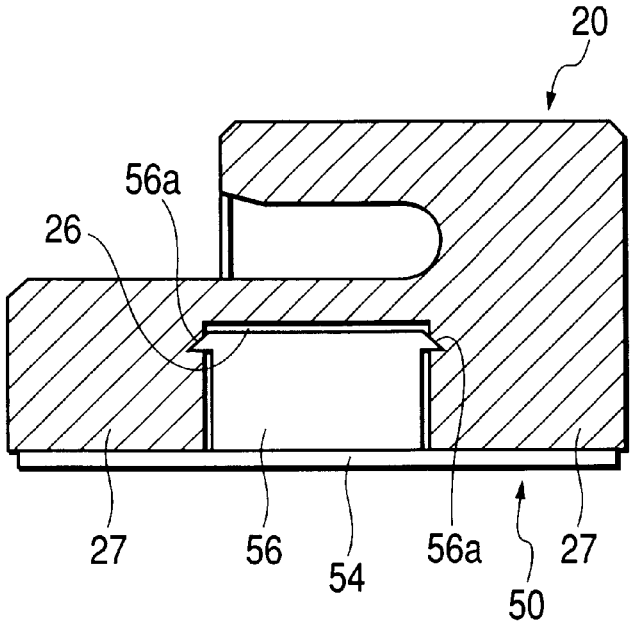
FIG. 7 is a sectional side view showing the reinforcing metal plate of FIG. 6 in a fixed state to the housing.
Figure 8:
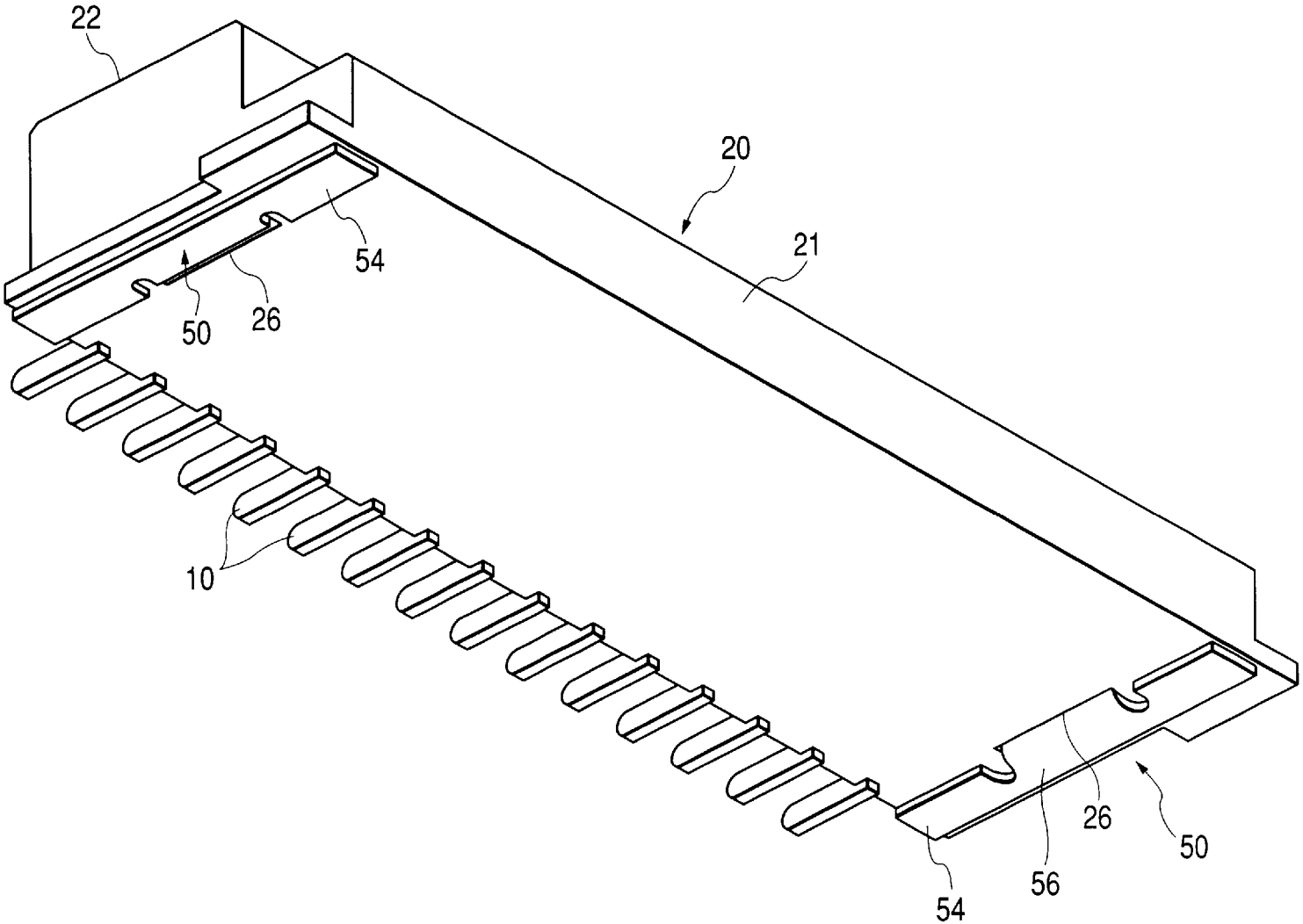
FIG. 8 is a perspective view of the state of FIG. 7 as seen from the bottom face side of the housing.

A second embodiment is shown in FIGS. 6 to 8. In this embodiment, an insertion slit 26 is formed at an intermediate position of the housing 20 in a back and forth direction. A part 56 to be fixed to the housing which is adapted to be inserted into the insertion slit 26 is erected upward from an intermediate position of the part 54 of the reinforcing metal plate 50 to be fixed on the board. The part 56 to be fixed to the housing is provided with hooks 56*a* projected from upper ends of both backward and forward end faces thereof. The part 56 to be fixed to the housing is so adapted to be fixed to the housing 20, when the hooks 56*a* bite into inner walls of the insertion slit 26.

Also in this embodiment, parts of the housing 20 located in the front and the back of the insertion slit 26 constitute restraining parts 27 which restrain the aforesaid part 56 to be fixed to the housing from the front and the back. Accordingly, an outer force applied to the housing 20 when the slide 30 is inserted and detached in the back and forth direction can be sufficiently withstood.

However, it is preferable that the aforesaid parts 55 to be fixed to the housing are constructed to be positioned at both sides of the housing in the back and forth direction, as shown in the first embodiment. If so constructed, the housing 20 can be reinforced at both the front and back sides, and therefore, a connector which is more favorable in strength can be realized.

Although in the above described embodiments, the connector of a type in which an end of the flat wiring member 40 is directly inserted into the housing 20 has been described, the on-board type connector according to the invention is not limited to this type, but can be applied to an ordinary connector in which a housing of a mating connector is engaged with the housing 20. In this case too, an effect of withstanding an outer force in the back and forth direction exerted when the mating connector is inserted and detached can be obtained.

As described herein above, according to the invention, there are formed, at both sides of the housing in the lateral direction, the insertion slits which open toward the bottom face of the housing and into which the parts to be fixed to the housing are inserted and fixed. Each of the slits is so shaped that the part to be fixed to the housing which has been press inserted into the slit may be restrained by the housing from the front and the back. Therefore, it is possible to attain effective reinforcement against an outer force in the back and forth direction with a simple structure, and accordingly, it is advantageous that the overload in strength exerted on the connecting positions between the terminals and the circuit board when the slider and so on is connected to and detached from the housing can be effectively reduced.

What is claimed is:

1. A connector, comprising:

a housing made of synthetic resin and having a bottom wall, the housing holding a plurality of terminals to be connected to a circuit board, the housing having at least one insertion slit formed therein, the insertion slit being open at said bottom wall, and at least one reinforcing metal plate that includes a circuit board fixing portion, which is affixed to the circuit board, and two housing fixing portions, wherein:

the at least one insertion slit comprises two slit portions that are separated by a restraining member;

the restraining member is formed in the insertion slit and includes a pre-formed dented portion on each side thereof, the dented portions being respectively in communication with the slit portions;

each of the housing fixing portions includes a hook; and the housing fixing portions of each reinforcing metal plate are affixed to the housing by being inserted respectively into the slit portions of a respective one of the at least one insertion slit through the bottom wall in an insertion direction until the hooks engage the dented portions.

2. A method of making the connector of claim 1, comprising:

molding the housing from the synthetic resin using two molds that each include a portion corresponding in shape and position to a respective one of the dented portions; and withdrawing one of the moids in a first direction and withdrawing the other of the molds in a second direction that is opposite to the first direction, the first and second directions being perpendicular to the insertion direction.

3. The connector of claim 1, wherein the connector includes two of the reinforcing metal plates that are identical in shape and two insertion slits.

4. The connector of claim 1, wherein the at least one reinforcing metal plate is symmetrical a seen in a lateral direction.

* * * * *